United States Patent [19]

Ditto

[11] Patent Number: 4,757,930

[45] Date of Patent: Jul. 19, 1988

[54] WEB INDICIA REFERENCE SIGNAL GENERATING SYSTEM

[75] Inventor: James W. Ditto, Golden, Colo.

[73] Assignee: Adolph Coors Company, Golden, Colo.

[21] Appl. No.: 902,192

[22] Filed: Aug. 29, 1986

[51] Int. Cl.[4] ..... B65H 23/04; B26D 5/20

[52] U.S. Cl. ..... 226/27; 226/29; 83/74; 83/76

[58] Field of Search ..... 226/27–31; 364/468, 469; 83/74, 76, 365, 370, 367, 269

[56] References Cited

U.S. PATENT DOCUMENTS

| | | | |
|---|---|---|---|
| 3,397,634 | 8/1968 | Betts et al. . | |
| 3,556,509 | 1/1971 | Crum . | |
| 3,559,568 | 2/1971 | Stanley . | |
| 3,601,587 | 8/1971 | Thiede . | |
| 3,774,016 | 11/1973 | Sterns et al. | 226/28 X |
| 4,264,957 | 4/1981 | Pautzke | 226/28 X |

FOREIGN PATENT DOCUMENTS

| | | |
|---|---|---|
| 1161525 | 1/1984 | Canada . |
| 0038164 | 10/1981 | European Pat. Off. . |
| 2088100 | 6/1982 | United Kingdom . |

*Primary Examiner*—John Petrakes
*Assistant Examiner*—Steven M. Dubois
*Attorney, Agent, or Firm*—Bruce G. Klaas; William P. O'Meara

[57] ABSTRACT

A method of generating a signal indicative of the passage of indicia on a moving web of material at a preselected reference station along the web without use of an indicia sensing device at the selected reference station comprising locating an indicia sensing device at a sensing station at a preselected distance of web travel upstream of the reference station; generating an indicia detection signal having sensing pulses coinciding with the passage of indicia at the sensing station; measuring the distance of web travel occurring after each sensing pulse in the indicia detection signal; generating an indicia reference signal having reference pulses coinciding with the passage of indicia at the selected reference station by providing a reference pulse corresponding to each sensing pulse and occurring thereafter at a point in time at which the measured distance of web travel after a corresponding sensing pulse is equal to the preselected distance of web travel between the sensing station and the preselected reference station.

4 Claims, 3 Drawing Sheets

WEB INDICIA REFERENCE SIGNAL GENERATING SYSTEM

BACKGROUND OF THE INVENTION

The present invention relates generally to control systems for phasing a moving web of material to operating machinery located at a fixed operating station along the web and, more particularly, to a reference signal generating system which utilizes a data processing means and a signal sensing device positioned remotely of the operating station to produce a reference signal indicative of the passage of indicia on the web past a fixed reference point located within the operating station.

Web phasing systems have long been employed for phasing repeating longitudinal portions of a web having a constant repeat length to operating machinery along the web. For example, a web phasing system is used in a cutterline which cuts carton blanks having printed graphics thereon in order to ensure that the cut made by the cutter device is always made at approximately the same position with respect to the graphics of each repeat length of the web. A phasing device is necessary to ensure that a longitudinal misalignment of the web such as caused by slippage in web conveying rolls, a web splice, or the like, will not cause each of the repeat length portions occurring after such slippage, splice, etc. to be placed out of registry with the operating station machinery. If a significant misregistry of a web repeat length portion and an associated operating machine such as a web cutter does occur, all succeeding portions of the web which are effected by such misregistry must usually by scrapped. Thus, an accurate web phasing device is essential for any commercial high-speed operation in which repeat length portions of a web are operated on at one or more operating stations along the web. To control the phasing of a web with a particular operating station it is necessary to monitor the degree of registry of web repeat length portions with operating station machinery in order to make the necessary adjustments in the web movement or, in some cases, in the operating station machinery movement so as to ensure proper phasing of the web and operating stations. Such monitoring is generally performed by a photoelectric scanning device, generally referred to in the industry as a "photo eye" unit, which senses register marks on the film web which are associated with each repeat length portion of the web. In an ideal control situation, the photo eye unit would be positioned within the operating station and would sense a register mark at exactly the time that the associated operation were being performed on the web. For example, in the case of a web carton blank cutting unit, the photo eye would be positioned within the cutter device and would sense a register mark on the web at exactly the time that the cutter were performing a cut. In such a situation, a cutter position reference signal would also be generated at the time that the cutter were oriented in the cutting position. The cutter position reference signal and the web indicia signal would be compared by associated circuitry or other data processing means such as a computer to determine the degree of misregistry of the web with the cutter. However, in most situations, it is physically impossible to locate a photo eye unit in exactly the correct position within an operating station such that the operating station machinery position reference signal and the indicia sensing signal associated with a repeat length portion of the web being processed will occur at the same time. In order to approximate a situation in which a web indicia signal will occur at the same instant as an operating station machine reference signal, a register mark sensing unit is often placed at a position at an integer number of repeat lengths upstream of an associated operating station, for example, five repeat lengths away. In such a situation, even though the register mark associated with a repeat length which is being operated on by the operating station is not sensed at the same time that a machine reference signal is generated, a register mark at a convenient location for the photo eye unit which would be, for instance, five repeat length away will be sensed at that time so long as the web repeat length distance remains constant throughout the web. However, a problem with such a sensing device placement system is encountered when web repeat length is subject to variation such as when the web being processed is a relatively extensible plastic film web. In such a situation, even a moderate increase or decrease in the repeat length of the web, e.g. ¼ inch in a 40 inch repeat length, will completely disrupt phasing control of the web because each succeeding repeat length error between the photo eye unit and operating station will produce an additive misregistry effect. Such misregistry will not be corrected by such a control system due to the erroneous assumption built into the control circuitry that the register mark associated with the subject operating station is located exactly five repeat length from the register mark associated with the sensing device. To applicant's knowledge, no one in the industry appreciated this phasing problem associated with extensible webs prior to applicant's identification of the problem.

A need thus exists for providing a sensing system for use in phasing which adequately accounts for variations in repeat length but which does not require a sensing device to be physically located within an operating station at the point where an associated operation is being performed on a web.

OBJECTS OF THE INVENTION

It is an object of the present invention to provide a web position monitoring system having a sensing device portion which is located at a position along the web physically remote from a web operating station and which generates a reference signal which corresponds in time to the passage of a register mark past a fixed reference point within an operating station.

It is another object of the invention to provide such a monitoring system which produces a correct reference signal whether or not the actual repeat length of an associated web is at variance with the design repeat length of the web.

It is another object of the invention to provide such a monitoring system which may be used in association with other control components to provide proper phasing of a web having repeat length portions which are subject to minor variations in length.

SUMMARY OF THE INVENTION

The present invention achieves the above-described objectives by the use of a sensing device positioned at a predetermined distance of web travel upstream of a selected reference point within an operating station and by use of a web distance measuring device such as an encoder associated with a web roll positioned proximate the register mark sensing device. Both the sensing device register mark detection signal and the encoder web travel signal are input to a data processing device such as a minicomputer. The data processing device monitors the distance of web travel occurring subsequent to the generation of each pulse in a detection signal indicative of the presence of a register mark at the sensing device. At a point in time whereat this distance of web travel after each detection pulse is equal to the distance between the register mark sensing device and the selected reference point in the operating station, the data processing device generates a reference pulse which is provided in a separate reference signal. Thus, the pulses in this reference signal correspond in time with the passage of a register indicia past the reference point in the operating station. The reference pulses in this reference signal may be compared to reference pulses in a machine position reference signal which occur at the point in time when a register mark is positioned at the operating station register point when the web is in proper registry with the operating station. Variations in the occurrence between the operating station machine position reference signal and the indicia reference signal generated by the data processing means thus accurately reflect the degree at which the web is out of phase with the operating station. Appropriate correction commands may thereafter be generated by the data processing means to rephase the web with the operating station machinery.

Thus, the present invention may comprise a method of generating a signal indicative of the passage of indicia on a moving web of material at a preselected reference station along the web without use of an indicia sensing device at the selected reference station comprising: (a) locating an indicia sensing device at a sensing station at a preselected distance of web travel upstream of the reference station; (b) generating an indicia detection signal having sensing pulses coinciding with the passage of indicia at the sensing station; (c) measuring the distance of web travel occurring after each sensing pulse in said indicia detection signal; (d) generating an indicia reference signal having reference pulses coinciding with the passage of indicia at said selected reference station by providing a reference pulse corresponding to each sensing pulse and occurring thereafter at a point in time at which said measured distance of web travel after a corresponding sensing pulse is equal to said preselected distance of web travel between said sensing station and said preselected reference station.

The invention may also comprise a method of generating a signal indicative of the passage of preselected reference points on a moving web of material at a preselected reference station along the web without use of an indicia sensing device at the selected reference station comprising: (a) providing indicia on the web which are associated with each reference point and which are positioned at a constant distance from each associated reference point; (b) locating an indicia sensing device at a sensing station at a preselected distance of web travel upstream of the reference station; (c) generating an indicia detection signal having sensing pulses coinciding with the passage of indicia at the sensing station; (d) measuring the distance of web travel occurring after each sensing pulse in said indicia detection signal; (e) generating an indicia reference signal having reference pulses coinciding with the passage of web reference points at said reference station by providing a reference pulse corresponding to each sensing pulse and occurring thereafter at a point in time at which said measured distance of web travel after a corresponding sensing pulse is equal to said preselected distance of web travel between said sensing station and said preselected reference station plus the distance between a reference point and an associated indicia wherein said distance between a reference point and an associated indicia is considered to have a positive value for a reference point located downstream of an associated indicia and is considered to have a negative value for a reference point located upstream of an associated indicia.

The invention may also comprise a method of phasing repeat length portions of a continuous web to an operating station through which the web passes, the operating station being of the type adapted to perform an operation at a prescribed position within each repeat length and being operable at a relatively constant rate, the web being associated with a web movement assembly operable at a selectively variable rate for phasing the web repeat length portions to the operating station, the web having a repeating register indicia positioned within each repeat length, comprising: (a) selecting a periodically reoccurring machine part angular position through which an operating machine part associated with said operating station cyclically passes during each operation performed on the web; (b) monitoring the operation of said operating machine and generating a machine signal indicative of said periodically reoccurring machine part position; (c) selecting a fixed reference point within the operating station through which the web passes that is positioned opposite a register indicia on the web at the occurrence of the selected machine part angular position during a properly phased operation; (d) sensing the passage of register indicia at a position substantially upstream of the operating station at a predetermined distance therefrom and generating a register signal indicative thereof; (e) continuously monitoring web travel into the operating station and generating a web travel signal indicative thereof; (f) from said register mark signal and said web travel signal generating a web reference signal which corresponds with the passage of said web register indicia at the operating station fixed reference point; (h) comparing said web reference signal with said machine signal; (i) varying the speed of said web in accordance with said comparison to maintain said web in proper phase with said operating station machinery.

The invention may also comprise a method of phasing repeat length portions of a continuous web to an operating station through which the web passes, the operating station being of the type adapted to perform an operation at a prescribed position within each repeat length and being operable at a relatively constant rate, the web being associated with a web movement assembly operable at a selectively variable rate for phasing the web repeat length portions to the operating station, the web having a repeating register indicia positioned within each repeat length, comprising: (a) selecting a periodically reoccurring machine position through which an operating machine associated with said operating station passes during each operation performed on the web; (b) monitoring the operation of said operating machine and generating a machine signal indicative of said periodically reoccurring machine position; (c) selecting a fixed reference point within the operating station through which the web passes; (d) determining a web reference point within a web repeat length that is positioned opposite the operating station fixed reference point at the occurrence of said periodically reoccurring machine position during a properly phased operation and determining the distance of the web reference point from the register indicia in the associated repeat length; (e) sensing the passage of register indicia at a position substantially upstream of the operating station at a predetermined distance therefrom and generating a register signal indicative thereof; (f) continuously monitoring web movement into the operating station and generating a web movement signal indicative thereof; (g) from said register mark signal and said web movement signal generating a web reference point signal which corresponds to the coincidence of a web reference point position within a repeat length and the operating station fixed reference point; (h) comparing said web reference point signal with said machine signal; (i) varying the speed of said web in accordance with said comparison to maintain said web in proper phase with said operating station machinery.

The invention may also comprise a web monitoring apparatus for producing a signal indicative of the passage of indicia on the web through a reference station along the web which is positioned remotely from an indicia sensing means comprising: (a) an indicia sensing means located at a sensing station at a preselected distance of web travel upstream from said reference station for sensing the passage of web indicia at said sensing station and generating a sensing station signal having sensing pulses indicative of the passage of sensed web indicia at said sensing station; (b) web travel measurement means for measuring the distance of web travel during selected periods of time and generating a distance signal indicative thereof; (c) data processing means for receiving said sensing station signal and said distance signal and for generating a reference signal having a reference pulse corresponding to each sensing pulse in said sensing station signal and occurring at a point in time after the occurrence of a sensing pulse coinciding with the measurement of an amount of web travel which is equal to said distance of web travel between said sensing station and said reference station; whereby said reference pulses in said reference signal occur at the point in time when an associated web indicia passes through said reference station.

DETAILED DESCRIPTION OF THE INVENTION

Figure 1:
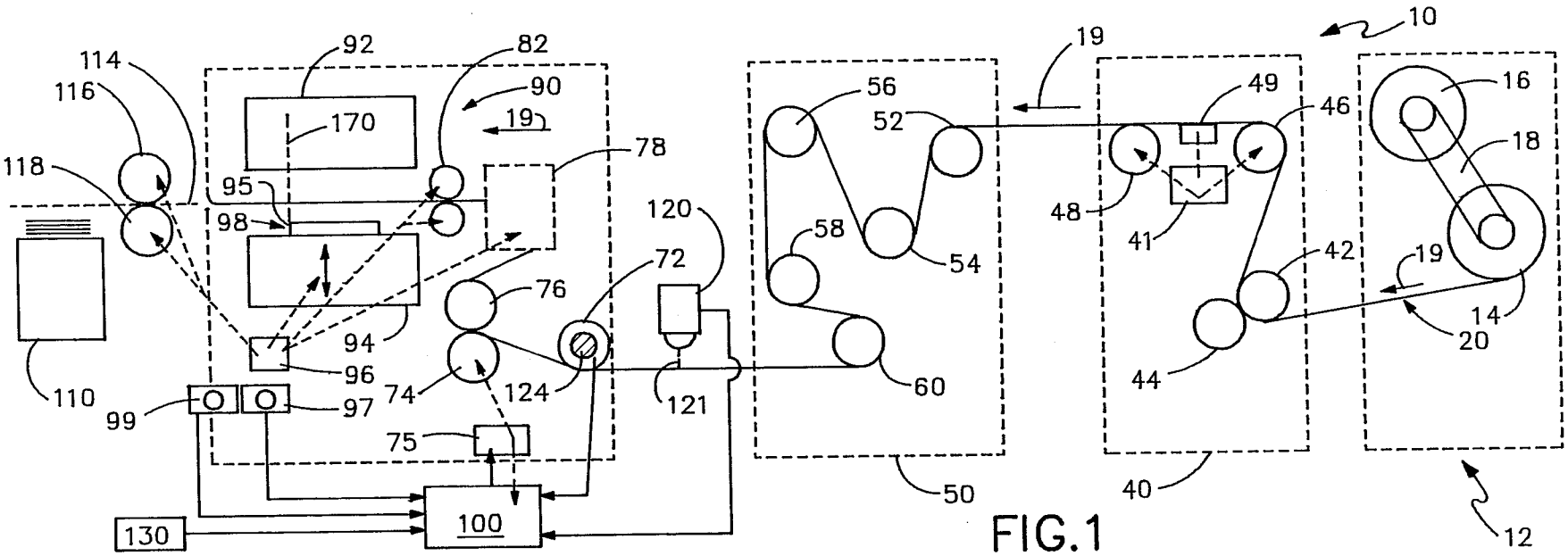
FIG. 1 is a schematic illustration of a continuous web and various operating stations used in processing thereof in which the control system of the present invention is utilized.

The sensing device signal correction system of the present invention may be used in a cutterline 10 as illustrated in FIG. 1. The cutterline comprises a series of different areas for performing operations on a continuous web of material resulting in the cutting of predetermined portions of the continuous material web 20 to form a plurality of individual cut blanks 112.

Figure 2:
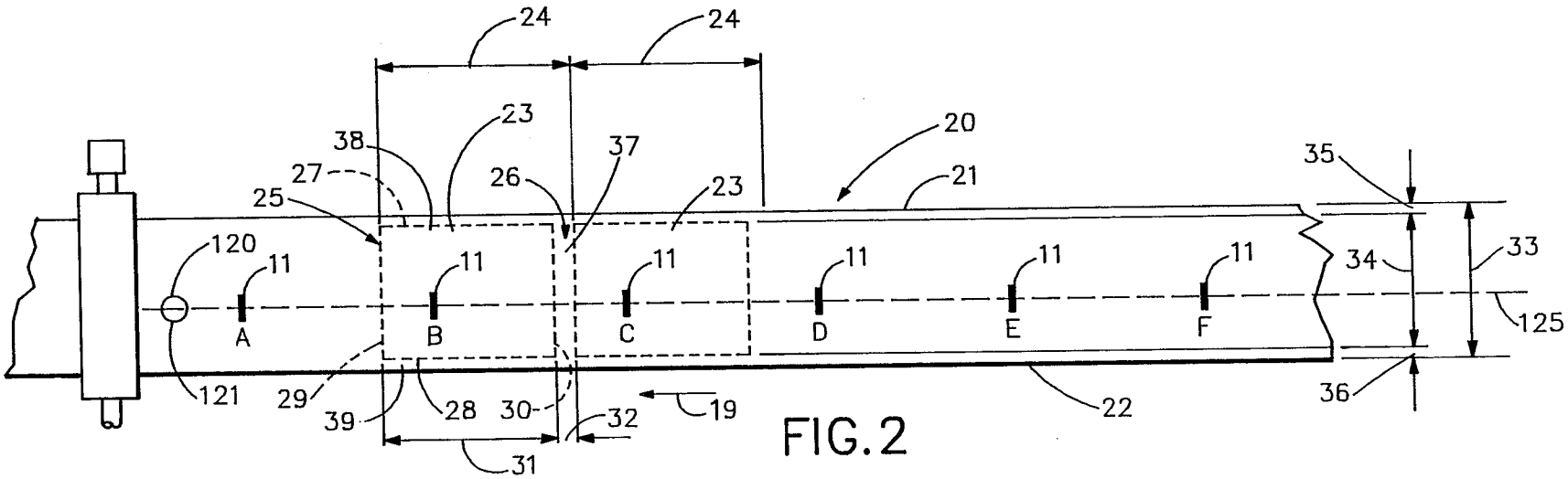
FIG. 2 is a top view of the web of FIG. 1.

The material web 20 moves through the machine in a longitudinal direction 19. As illustrated in FIG. 2, the web 20 comprises a pair of parallel lateral edges 21, 22. A repeating pattern of graphics 23 including register marks 11 designated individually as A, B, C, D, etc. are printed on the web 20 and repeat at predetermined substantial constant distance intervals along the web hereinafter referred to as the "repeat length" 24. Small variations in the repeat length may occur due to tension changes, etc. in the moving web. Within each repeat length 24 is a design cutting location 25, 26, etc. The "design cutting location" refers to the location of the cut which the cutter 98 will cut in the web if the system is operating correctly. The design cutting location thus has a preset relationship with respect to the graphics and associated register indicia 11 in any repeat length of web material. It will be appreciated that this design cutting location may vary from the actual cut made in each repeat length if the web is not properly longitudinally phased and laterally aligned with the cutter. In the embodiment described the shape of the design cut is rectangular and comprised lateral edges 27, 28 positioned generally parallel the web lateral edges 21, 22 and also comprises a leading edge 29 and a trailing edge 30 positioned generally perpendicular the lateral edges of the web. Each repeat length 24 comprises the longitudinal dimension 31 of the design blank pattern i.e. the length of the pattern and may also comprises the longitudinal dimension 32 of a portion of the web 37 positioned between the design cuts 25, 26 which becomes scrap subsequent to the cutting of the web. This scrap portion 37 is preferably kept to a minimal size and in some applications may be entirely eliminated. The lateral dimension or width of the web 33 comprises the lateral dimension 34 of the blank cutting pattern and the lateral dimension 35, 36 of the portion of the web 38, 39 positioned outwardly of the design cut which will also become a portion of the scrap after the web is cut and which is also preferably kept to a minimal size.

The first station of the cutterline 10 is an unwind stand 12 at which an unwind roll 14 and a reserve roll 16 are mounted on a conventional yolk 18. Each of the rolls 14, 16 comprises a wound continuous web of material such as paper, plastic film, paper-film composite, or the like. A typical roll of material may have a width of 44 inches and a maximum diameter of 80 inches and may weigh on the order of 2½ tons. The material web 20 is pulled from the unwind roll 14 until the roll is exhausted. The trailing edge of the web roll 14 is then spliced to the leading edge of material on the reserve roll 16 at which point the reserve roll becomes the unwind roll and another roll is mounted on the yolk 18 in place of roll 14. Such unwind and splicing operations are conventional and well-known in the art. The continuous web 20 is drawn from the unwind roll 14 by a pair of pinch rolls 42, 44 located in a decurl unit 40 which may also be used in the web splicing operation. Subsequent to passing through the pinch rolls 42, 44 the web 20 passes over decurl rolls 46, 48 which take out some of the curl which sets into a roll of material over the period in which it is in storage. The decurl rolls may also be used for lateral alignment of the moving film web 20. The rolls 46, 48 are mounted on a frame which may be tilted from side to side to shift the web laterally as it crosses the rolls to maintain the web in a proper lateral position. A web edge sensor assembly 49 is used to determine the lateral position of an edge portion of the film web and, based upon this determination, provides a signal to a hydraulic drive unit 41 which tilts the frame supporting rollers 46, 48 in response to the signal to maintain the web 20 in a laterally centered location in decurl unit 40. Subsequent to passing through the decurl unit 40 the web may pass into a string insertion unit 50 in which strings may be glued onto the web to increase web strength. The actual assembly for string insertion may be of the type illustrated in U.S. Pat. No. 4,496,417 of Haake et al which is hereby incorporated by reference. The web passes over a series of rolls 52, 54, 56, 58, 60 in the string insertion unit. After leaving the string insertion unit 50 the web 20 passes into a cutter creaser assembly 70 which comprises a plurality of rolls including idler roll 72 and metering nip rolls 74, 76 driven by variable speed motor 75. Variations in motor 75 speed may be produced by a mechanical correction motor and differential assembly (not shown) or by direct electronic command to motor 75. Both methods of speed control are well-known and commonly practiced in the art. After leaving metering nip rolls 74, 76 the web passes into a moving curved plate assembly 78 of a type known in the art. The web next passes through driven cutter feed rolls 82, 84 prior to entering a cutter unit 90 comprising an upper fixed cutter portion 92 and a lower reciprocating cutter portion 94 which is caused to reciprocate at a constant speed by a cutter drive motor 96. Fixed knives 98 mounted on the lower reciprocating cutter portion 94 have the same configuration as the design cut 25, 26. Knives 98 have a leading edge 95 which corresponds to leading edge portion 29 of a design cut. Subsequent to being cut the web passes into driven exit roll nip 116, 118. Feed rolls 82, 84 and exit rolls 116, 118 operate simultaneously and are rotated and stopped periodically such that the web portion positioned therebetween is stationary when cut. The portion of the web between rolls 82, 84 and rolls 74, 76 is taken up by curved plate assembly 78 during the period when rolls 82, 84 and 116, 118 are stopped to maintain a relatively constant tension in that web portion. However, the total distance of web travel between metering rolls 74, 76 and cutter blades 98 remains at an effectively constant value from one repeat length cutting operation to the next.

Rolls 82, 84; curved plate assembly 78 and rolls 116, 118 are operated by conventional cam timing devices associated with a driven shaft portion of cutter motor 96. A cutter encoder 97 is also driven by a shaft associated with cutter motor 96 and produces a signal which is proportional to the angular displacement of the cutter motor shaft. A cutter shaft reference position signal generator 99 also driven by the cutter motor shaft produces a single pulse signal during each cycle of operation of the cutter which is indicative of a cyclically repeating cutter position which in one preferred embodiment is the bottom of the cutting stroke. Subsequent to being cut by the cutter unit 90 the web passes over a delivery table 110 where cut blanks 112, in the shape of design cuts 25, 26, etc., formed in the cutting operation are caused to be deposited on the delivery table in stacked relationship. Operating personnel periodically remove the stacked blanks 112, placing the blanks on pallets, etc. for subsequent transport to other machinery for further forming operations such as folding. The cutter unit 90 and stacking table 110 assembly may be of a conventional type well-known in the art. For example, the cutter unit may be model no. Z714 manufactured by Zerand of New Berlin, Wis.

A central control problem solved by the present invention is the longitudinal phasing of a web 20 to a cutter 90 to ensure that the cutter cuts the web precisely at the design cuts 25, 26 rather than at some other longitudinal position which is longitudinally misaligned with the graphic 23 in each repeat length 24. The apparatus for providing longitudinal monitoring and control of the web 20 will now be described.

As shown by FIG. 2, a series of longitudinally spaced-apart laterally extending register marks are repeated at approximately equal repeat length intervals along the film web 20. The marks are positioned in a predetermined fixed relationship relative the repeating graphics and associated design cuts 25, 26 on the web 20 and are also located in generally fixed relationship between the lateral edges 21, 22 of the web 20. The marks 11 extend laterally of the web and are in longitudinal alignment with respect to the web such that all of the marks will be detected by a single mark detection unit positioned at a fixed location above the web and defining a longitudinally extending mark detection path 125. In the embodiment illustrated in FIG. 1, a conventional photo eye assembly 120 is positioned between the mark detection string insertion assembly 50 and the cutter assembly 70 at a location 121 a predetermined known distance of web travel from the cutter unit 90. An encoder unit 124 which generates a predetermined number of electronic pulses per revolution of an associated roller is mounted on roller 72 immediately downstream of photo eye assembly 120. The roller 72 engages the web 20 passing thereover in non-slipping contact and thus the number of pulses from encoder 124 during any particular time interval is linearly proportional to the distance that web 20 has travelled during that time interval. A data processing unit 100 (which may include a conventional microcomputer or minicomputer with appropriate control software and electronics) receives signals from the encoders 97, 124, photo eye 120, cutter position signal generator 99, and also receives a motor speed indicating signal from metering roll drive motor 75. An input terminal means such as keyboard 130 is provided to enable operator input of certain values particular to a web being run, etc.

Figure 3:
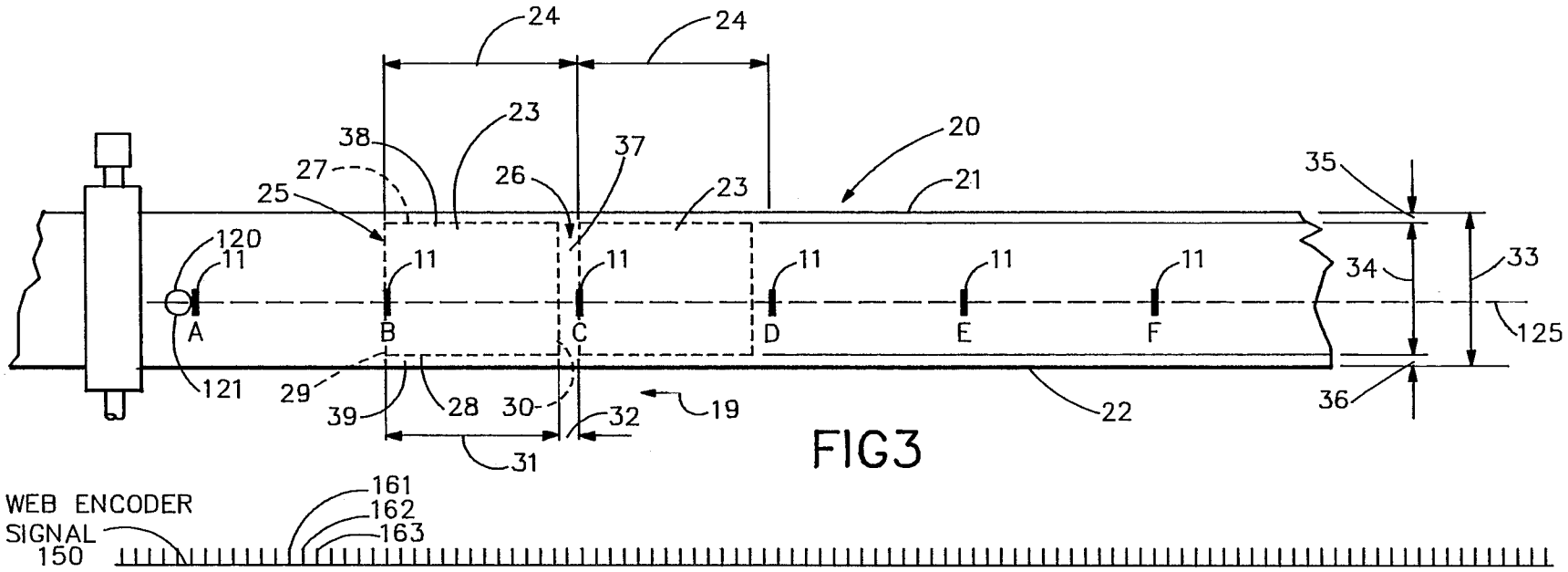
FIG. 3 is another embodiment of the web of FIG. 1.
Figure 4:
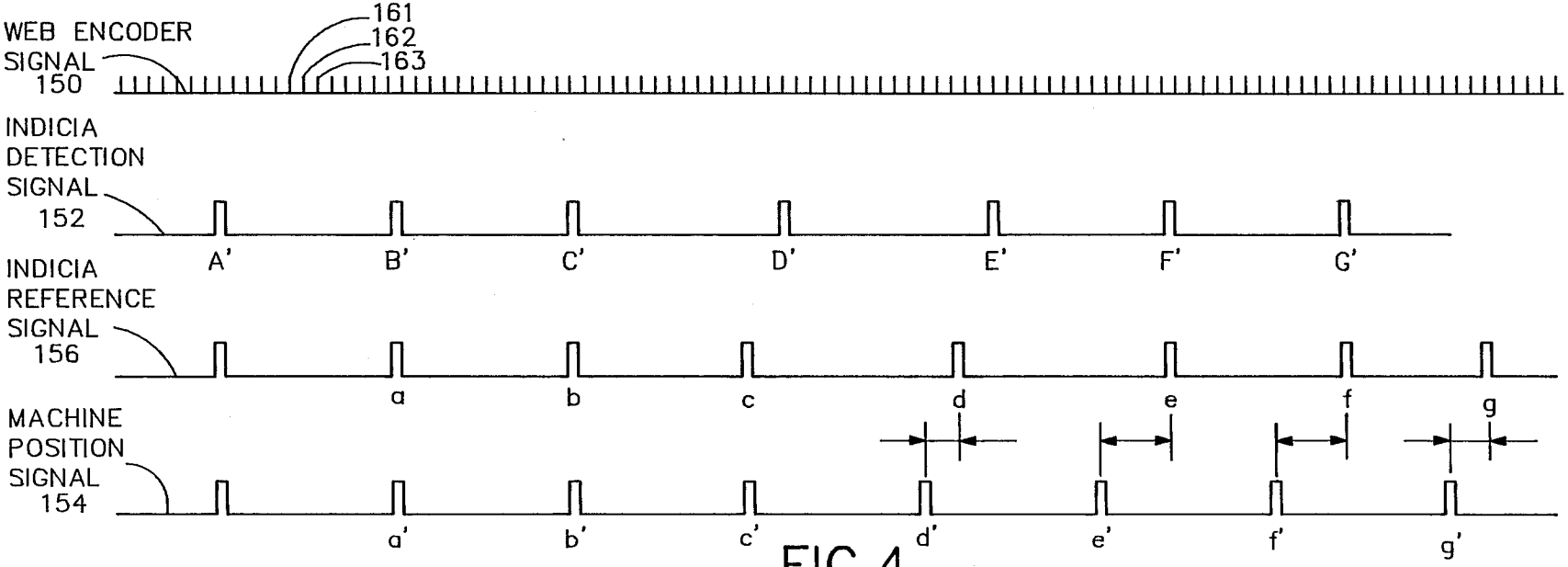
FIG. 4 is a schematic view of certain signals generated by the control system of FIG. 1.

Operation of the corrected signal generating system of the present invention will now be described. FIG. 4 illustrates electronic pulse signals provides by web encoder unit 124, photo eye unit 120, cutter position indicating signal generator 99, and data processing unit 100 at 150, 152, 154 and 156, respectively. Relatively few encoder pulses 160, 161, 162, etc. per unit of length are shown to avoid cluttering the drawing, however, it is to be understood that in an actual production unit a high resolution encoder generating several hundred pulses per inch of web travel would be used to obtain precise phasing control. To further simplify the explanation, an embodiment of the system in which the register mark 11-A, B, C, D, etc. in each repeat length is positioned in coincidence with the leading edge 29, etc. of an associated design cut will initially be described with reference to FIG. 3. In the described embodiment, the position of photo eye unit 120 is one repeat length of web travel from the leading edge 95 of cutter knives 98.

The encoder pulse signal 150 from web encoder 124 and the indicia detection signal 152 from photo eye unit 120 are both input to the data processing unit 100. The rectangular shape of each detection signal pulse A', B', C', D', E', F', G', etc. is indicative of the sensing of a dark region on the web provided by an associated register mark A, B, C, D, etc., respectively. The leading edge of each pulse is preferably used as the reference position in web travel measuring operations described below. Appropriate software and/or circuitry is provided in processing unit 100 for the functions described below and the provisions of such software and/or circuitry is within the level of skill of a person with ordinary skill in the art.

Processing unit 100 measures the distance of web travel occurring after each pulse A', B', C', D', etc. in the indicia detection signal 152 by counting the web encoder pulses occurring after each of the pulses A', B', C', D', etc. This encoder pulse counting procedure continues until a number of encoder pulses is reached that is the equivalent of the distance between the photo eye unit sensing position 121 and a predetermined longitudinal position 170 within the cutter 90 which in the illustrated embodiment is opposite the leading edge portion 95 of the cutter blades 98. As previously mentioned, photo eye position 121 in the described embodiment is chosen such that the distance of web travel between position 121 and 170 is one ideal repeat length 24. However, any distance which positions unit 120 reasonably close to cutter assembly 70 may be used. The processing unit 100, after counting a number of encoder pulses equal to the web distance between 121 and 170 (one ideal repeat length), generates a pulse in reference pulse signal 156. In the illustrated embodiment, reference pulses a, b, c, d, e, f, g, etc. correspond to detection signal pulses A', B', C', D', E', F', G', etc., respectively. Since photo eye sensor unit 120 is positioned one ideal repeat length of web travel upstream of cutter station 170, reference signal pulses a, b, c, d, etc. occur at the same time that the marks A, B, C, D, etc. which produced detection signal pulses A', B', C', D', etc. are located at station 170, i.e. when register indicia A associated with design cut unit 25 is sensed by unit 120 produces detection pulse A' and, after the web has travelled one ideal repeat length, a pulse "a" is produced by processing unit 100 at the time mark A is located at 170. In the embodiment illustrated, the repeat length between adjacent marks AB, BC, CD and FG are equal to the ideal repeat length 24 but the repeat length between marks DE and EF are 20% longer than the ideal repeat length. Such a large variation in repeat length is unlikely in an actual operating system but is shown here to facilitate the description of the invention. A cutter position indicating signal 154, which is preferably produced by a rotating motor shaft of the cutter unit, is provided which occurs at the time the cutter begins its cut. This machine position thus corresponds to points in time when the leading edge 29 of each design cut 25, 26 etc. should be positioned at station 170 for properly phased cutting. The machine reference pulse signals which are output when the cutter is at the bottom of a cut are represented at a', b', c', d', e', f', g', etc. These pulses coincide in time with reference pulses a, b, c, d, etc., respectively, when the web is properly phased to the cutter. As shown by FIG. 4, machine position signal pulses d', e', f' and g' are out of phase with pulses d, e, f and g because of the repeat length error between DE and EF. The amount of this error is determined by processing unit 100 by counting the web encoder pulses occurring between associated pairs of pulses dd', ee', ff'.

In the example illustrated in FIG. 4, the computer has not yet produced a control signal to correct this phasing error. However, it will be understood that the correction signal may be generated by computer 100 which is proportional to the measured error distance dd', ee', ff', etc. to vary the speed to drive motor 75 to bring the web into phase with the cutter. Apparatus and operation of phase correction motors etc. are described in detail in U.S. Pat. No. 4,549,917 of Jensen which is hereby incorporated by reference for all that it discloses.

A web having a configuration in which each register mark 11 is positioned in spaced relationship from the web portion 29 that is to be registered with a particular reference point 170 in an operating station 70 is illustrated In FIG. 2. In such a situation, a reference signal indicative of the passage of web portion 29 at a reference point 170 is generated by counting web encoder pulses after each indicia sensing pulse up to a total distance value equal to the distance between sensing station position 121 and operating station reference position 170 plus the distance between the portion of the web 29 to be registered and the associated register indicia 11 wherein the distance between 11 and 20 is treated as having a positive value if 29 is upstream of 11 and is treated as having a negative value if, as in the illustrated embodiment, web reference portion 29 is positioned downstream of register indicia 11.

Figure 5:
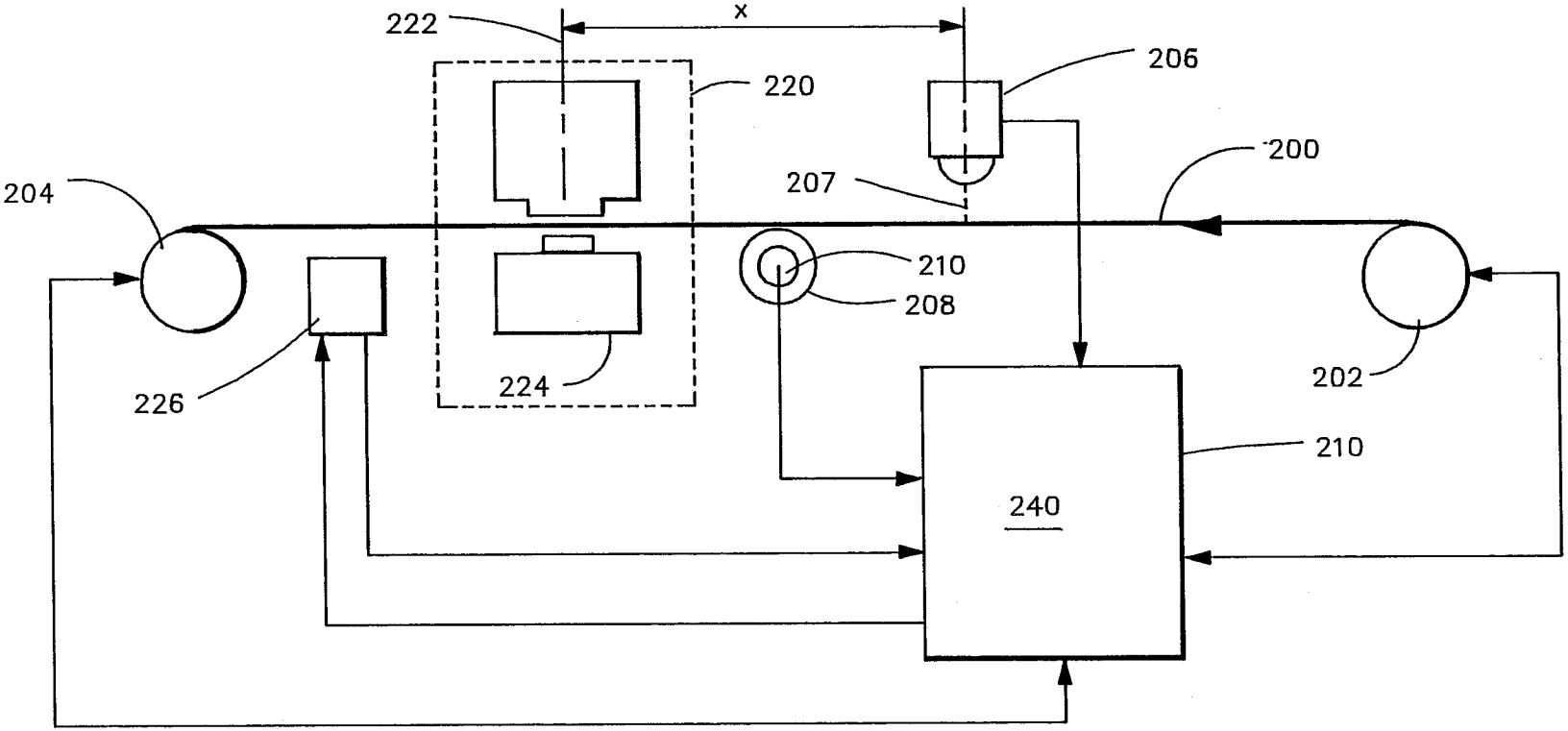

Another embodiment of the invention is illustrated in FIG. 5 in which a web 200 mounted between a driven unwind roll 202 and a driven wind up roll 204 passes through an operating station 220 at which material is sprayed onto a selected portion of each repeat length of the passing web. The web 200 may have the same configuration as web 20 illustrated in FIG. 2 and is moved at a relatively constant velocity between roll 202 and 204. Operating station reference position 222 is selected as the position at which a spray nozzle is positioned which sprays a small area web portion located at 11 when the web is properly phased.

An indicia sensing unit 206 is positioned at 207 at a known distance x which in one embodiment is five ideal repeat lengths of web travel upstream of operating station reference position 222 and generates a reference pulse each time a web indicia 11 is sensed. An operating station pumping unit 224 periodically discharges spray at reference position 222 at a normally constant cyclic rate which is dependent in the speed of operation of drive motor 226. Motor 226 provides a spray discharge reference signal to a computer 240 which also receives reference signals from web indicia sensing unit 206, web encoder 208, and a speed signal from driven rolls 202, 204. Computer 240 generates a web indicia reference signal having pulses produced after each detection pulse from sensing unit 206 occurring after counted encoder pulses from encoder 210 indicate that a distance of web travel equal to x has occurred. This reference signal is compared to the signal from 226 for determining the amount of phasing error in the system. In one control mode, the computer 240 produces a control signal to temporarily vary the speed of rolls 202, 204 to correct any detected phasing error by varying web speed. In another control mode, computer 240 produces a control signal to temporarily vary the frequency of operation of pumping unit 224 by varying the speed of motor 226 to phase the operating station to the web 200.

It is contemplated that the inventive concepts herein described may be variously otherwise embodied and it is intended that the appended claims be construed to include alternative embodiments of the invention except insofar as limited by the prior art.

What is claimed is:

1. A method of phasing repeat length portions of a continuous web to a machine located at an operating station through which the web passes, the machine being a cyclically operable machine of the type adapted to perform an operation at a prescribed position within each repeat length portion of the web, the web having a register indicia positioned at a predetermined location within each repeat length portion thereof, the repeat length portions of the web ordinarily having a constant predetermined design length but being subject to deviation from said predetermined constant design length whereby a series of adjacent repeat length portions may each comprise a length greater than or less than said predetermined design length, comprising:

(a) selecting a periodically reoccurring machine position through which said machine cyclically passes during each operation performed on the web;

(b) monitoring the operation of said machine and generating a machine signal indicative of said periodically reoccurring machine position;

(c) selecting a fixed reference point within the operating station through which the web passes that is positioned opposite a register indicia on the web at the occurrence of the selected machine position during a properly phased operation;

(d) sensing the passage of register indicia at a sensing station positioned more than one repeat length upstream of the operating station fixed reference point and at a predetermined distance from the fixed reference point and generating a register signal indicative thereof;

(e) continuously monitoring web travel into the operating station and generating a web travel signal indicative thereof;

(f) from said register signal and said web travel signal generating a web reference signal which corresponds with the passage of said web register indicia at the operating station fixed reference point, regardless of whether the actual length of repeat length portions positioned between the sensing station and the operating station are equal in length to said predetermined design repeat length;

(h) comparing said web reference signal with said machine signal;

(i) varying the relative speed between web movement and machine movement in accordance with said comparison to maintain said web in proper phase with said machine.

2. The invention of claim 1 wherein generating said register signal comprises generating register signal pulses coinciding in time with said sensing of each register indicia at said sensing station; and wherein generating said reference signal comprises generating reference signal pulses corresponding to each register indicia after the occurrence of a corresponding register indicia pulse and at a point in time thereafter, when said web travel signal indicates that the web has moved a distance equal to said predetermined distance between said fixed reference point in the operating station and said sensing station.

3. A method of phasing repeat length portions of a continuous web to a machine located at an operating station through which the web passes, the operating station being of the type including a cyclically operable machine adapted to perform an operation at a prescribed position within each repeat length and being operable at a relatively constant rate, the web being associated with a web movement assembly operable at a selectively variable rate for phasing the web repeat length portions to the operating station, the web having a register indicia positioned within each repeat length portion thereof, the repeat length portions of the web ordinarily having a constant predetermined design length but being subject to deviation from said predetermined constant design length whereby a series of adjacent repeat length portions may each comprise a length greater than or less than said predetermined design length, comprising:

(a) selecting a periodically reoccurring machine position through which said machine cyclically passes during each operation performed on the web;

(b) monitoring the operation of said machine and generating a machine signal indicative of said periodically reoccurring machine position;

(c) selecting a fixed reference point within the operating station through which the web passes;

(d) determining a repeating web reference point location within each web repeat length such that said web reference point is positioned opposite the operating station fixed reference point at the occurrence of said periodically reoccurring machine position during a properly phased operation and determining the distance between the web reference point and the register indicia located in the same repeat length;

(e) sensing the passage of register indicia at a sensing station positioned more than one repeat length upstream of the operating station at a predetermined distance therefrom and generating a register signal indicative thereof;

(f) continuously monitoring web movement into the operating station and generating a web movement signal indicative thereof;

(g) from said register signal and said web movement signal generating a web reference point signal which corresponds to the coincidence of said web reference point and the operating station fixed reference point, regardless of whether the actual length of repeat length portions positioned between the sensing station and the operating station are equal in length to said predetermined design repeat length;

(h) comparing said web reference point signal with said machine signal;

(i) varying the speed of said web in accordance with said comparison to maintain said web in proper phase with said operating station machine.

4. A web monitoring apparatus for producing a signal indicative of the passage of repeating indicia on the web through a reference station along the web which is positioned remotely from an indicia sensing means, the repeating inidicia being positioned at ordinarily constant repeat length intervals but which are subject to deviation from said constant length spacing, comprising:

(a) an indicia sensing means located at a sensing station at a preselected distance of web travel greater than one repeat length upstream from said reference station for sensing the passage of web indicia at said sensing station and generating a sensing station signal having sensing pulses indicative of the passage of sensed web indicia at said sensing station;

(b) web travel measurement means for measuring the distance of web travel during selected periods of time and generating a distance signal indicative thereof;

(c) data processing means for receiving said sensing station signal and said distance signal and for generating a reference signal having a reference pulse corresponding to each sensing pulse in said sensing station signal and occurring at a point in time after the occurrence of a sensing pulse coinciding with the measurement of an amount of web travel which is equal to said distance of web travel between said sensing station and said reference station which is greater than one repeat length; whereby said reference pulses in said reference signal occur at the point in time when an associated web indicia passes through said reference station regardless of whether the actual distances between repeating indicia in the web portion positioned between said sensing station and said reference station are equal to said predetermined design repeat length.

* * * * *